US006163945A

United States Patent [19]

Amano et al.

[11] Patent Number: 6,163,945

[45] Date of Patent: Dec. 26, 2000

[54] BROKEN PIECE COLLECTING ASSEMBLY FOR FASTENER SETTING TOOL

[75] Inventors: Toshiaki Amano; Yoshiaki Koike, both of Toyohashi, Japan

[73] Assignee: Emhart Inc., Newark, Del.

[21] Appl. No.: 09/522,665

[22] Filed: Mar. 10, 2000

[30] Foreign Application Priority Data

Mar. 17, 1999 [JP] Japan ..... 11-072322

[51] Int. Cl.[7] ..... B21D 31/00; B21J 15/20

[52] U.S. Cl. ..... 29/243.523; 29/243.525; 72/391.4

[58] Field of Search ..... 29/243.523, 243.524, 29/243.525; 72/391.4

[56] References Cited

U.S. PATENT DOCUMENTS

| | | | |
|---|---|---|---|
| 3,329,000 | 7/1967 | Schwab et al. | 72/391.4 |
| 4,281,531 | 8/1981 | Ehmann | 72/391.4 |
| 4,454,746 | 6/1984 | Schwab | 72/391.4 |
| 4,887,450 | 12/1989 | Gast et al. | 72/391.4 |
| 4,888,974 | 12/1989 | Mandell | 29/391.4 |
| 5,086,551 | 2/1992 | Shamaly et al. | 29/243.523 |
| 5,485,727 | 1/1996 | Godfrey | 29/243.523 |
| 5,598,619 | 2/1997 | Rosier | 29/243.523 |

FOREIGN PATENT DOCUMENTS

| | | |
|---|---|---|
| 62-105735 | 6/1987 | Japan . |
| 7-23087 | 5/1995 | Japan . |
| 7-299539 | 11/1995 | Japan . |

*Primary Examiner*—David Jones
*Attorney, Agent, or Firm*—Edward D. Murphy

[57] ABSTRACT

A fastener setting tool is constructed so that the mandrel of a fastener is inserted into a nose at the front end of the tool; the body of the fastener projected from the nose is inserted into the mounting hole of a base member such as a panel; under that condition, the mandrel is pulled enough to break the mandrel to enlarge the shank of the fastener body to fix the fastener by the enlarged shank portion and a flange of the fastener body. The tool also includes a broken piece collecting assembly 30 for collecting, through a path 9 within the tool, the broken pieces 37 of the mandrels, which are broken by the above pulling operation. The broken piece collecting assembly comprises a container 15 encircling the outlet port of the path and extending to elongate the path for collecting the broken pieces as discharged from the path; and a broken piece entangling prevention means disposed in the container. The broken piece entangling prevention means comprises an elongated broken piece receiver member 31 extending in the container along the axis of the path. The broken piece receiver member 31 is provided with an elongated groove 34 to receive the broken piece 37 outputted from the path in its existing posture.

12 Claims, 12 Drawing Sheets

BROKEN PIECE COLLECTING ASSEMBLY FOR FASTENER SETTING TOOL

BACKGROUND OF THE INVENTION

The present invention relates to a fastener setting tool of type that breaks the mandrel of the fastener such as blind rivet and lock-bolt upon fastening operation, and more specifically relates to a blind rivet setting tool having a broken piece collecting assembly for collecting the broken pieces of the mandrels from a nose through a path within the tool.

It is well known that a blind rivet comprises of a hollow rivet body and a mandrel inserted into the rivet body. Generally, a hydraulic actuated blind rivet setting tool is used to fasten the blind rivets to a workpiece. The blind rivet setting tool is provided with a chuck mechanism for holding the mandrel of the blind rivet, at the nose end of an elongated housing. The mandrel of a blind rivet is inserted into the nose, and the rivet body projected from the nose is inserted into the mounting hole of the workpiece such as a panel. When the rivet setting tool is triggered under that condition, a chuck mechanism is driven in a retracting direction in the housing by its hydraulic piston, so that the mandrel is pulled enough to break the mandrel at a predetermined breaking point to enlarge the shank portion of the rivet body to fix the rivet body to the workpiece by the enlarged shank portion and a flange of the rivet body. Furthermore, the broken pieces of the mandrel are released from the chuck mechanism, transported in an axial direction within the housing, and collected in a broken piece collecting container mounted at other end of the housing. In order to transfer the broken pieces to the broken piece collecting container, a path formed in the housing through which the broken piece passes or a mechanism for applying a suction negative pressure on the collecting container may also be provided. One example of such fastener setting tools is described in Japanese Patent Laid-Open No. 07-299539. Also, in Japanese U. M. Publication No. 07-023087, a similar blind rivet setting tool having a collecting container for containing the broken pieces of the mandrels at the rear end of the elongated housing of the tool is disclosed.

FIGS. 1 and 2 show one example of prior blind rivet setting tools similar to that of above Japanese Patent Laid Open No. 07-299539. In FIGS. 1 and 2, a blind rivet setting tool 1 includes a handle 2, a hydraulic pressure generating means 3, and a housing 5. A nose 6 at the front end of the housing 5 is provided with a chuck mechanism (not shown) for holding the mandrel of the blind rivet. Furthermore, in the rear portion of the housing 5, a path 9 is formed through which the broken piece of the mandrel passes from the nose of the front end to the rear end of the housing. The broken piece of the mandrel is transported into a collecting container 7, for example, by a suction negative mechanism or the like as shown in FIGS. 4(*a*) and (*b*) of Japanese Patent Laid Open No. 07-299539. When a certain amount of the broken pieces have been collected in the collecting container 7, the collecting container 7 is rotated to align a opening 10 of the outer container portion with a opening of the inner container portion as shown in FIG. 2, and then the broken pieces of the mandrels are discharged from that aligned openings for disposal .

There are various types of the blind rivet. Thus, the lengths of the broken pieces of the mandrels are different according to their types. If the length of the broken piece is near the inner diameter of the collecting container, the broken pieces might be engaged with the inner wall of the container, so the broken pieces of the mandrels could not disposed. This situation is shown in FIGS. 3(*a*) and (*b*). If the broken pieces 11 of the mandrels are entangled to each other as shown in FIG. 3(*b*), they block the outlet port of the path 9 to be accumulated within the path 9 of the housing, and finally they interfere with the operation of the blind rivet setting tool. Furthermore, in the case that the collecting container structure shown in FIG. 2, there is a fear that the opening 10 could not be opened. Therefore, it is desirable to eliminate the entangling of the broken pieces within the collecting container. Japanese U. M. Laid Open No. 62-105735 discloses a safety cover assembly which prevents a risk of emitting the broken pieces, by mounting a cylindrical safety cover having a small diameter on the outlet port of the path for the broken pieces. Since this safety cover is for receiving the broken pieces one by one to discharge them outside, rather than for providing a collecting container for the broken pieces, it does not resolve the above problem of entangling of the broken pieces as discussed above.

SUMMARY OF THE PRESENT INVENTION

An object of the present invention is, in a fastener setting tool having a container for collecting the broken pieces of fasteners such as blind rivets or lock-bolts which are fastened by breaking its mandrel, to prevent the broken pieces of the mandrels from entangling to each other in the collecting container.

In order to accomplish above object, according to the present invention, there is provided a fastener setting tool which is constructed so that the mandrel of a fastener is inserted into a nose at the front end of the tool; the body of the fastener projected from the nose is inserted into the mounting hole of a workpiece such as panel; under that condition, the mandrel is pulled enough to break it to enlarge the shank of the fastener body to fix the fastener to a workpiece by the enlarged shank portion and a flange of the fastener body; and the fastener setting tool comprises a broken piece collection assembly for collecting, from the nose through a path within the tool, the broken pieces of the mandrels which are broken by the above pulling operation. The fastener setting tool is characterized in that the broken piece collection assembly comprises a container enclosing the outlet port of the path and extending to elongate the path to collect the broken pieces discharged from the path, and a broken piece entangling prevention means disposed in the container, the broken piece entangling prevention means comprising an elongated broken piece receiver member extending in the container along the axis of the path, the broken piece receiver member being provided with an elongated groove to receive the broken piece discharged from the path in the posture as it is discharged.

In the present invention, each of broken pieces of the mandrels discharged from the path in the housing is temporarily received to be kept its posture in the axial direction, and then dropped into the container, so they might not upset within the container, and be prevented from entangling each other even if many broken pieces are contained within the container. Accordingly, the broken pieces in the container can smoothly be disposed because of no fastening obstacle due to the entangling of the broken pieces. Furthermore, the fastener which can be used in the tool may be of any type of blind rivet, lock-bolt or the like, so long as the mandrel of the fastener is broken during fastening.

BRIEF DESCRIPTION OF THE ACCOMPANYING DRAWINGS

Figure 3A:
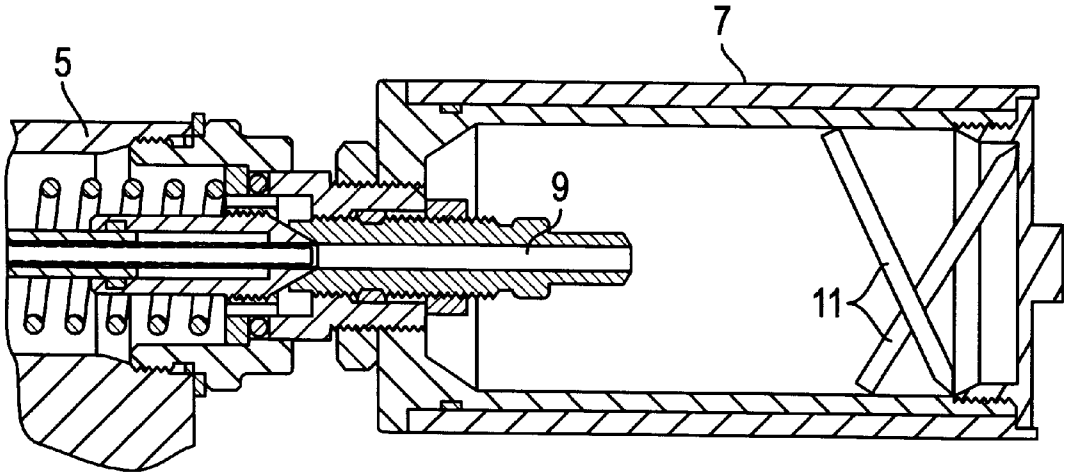
Figure 3B:
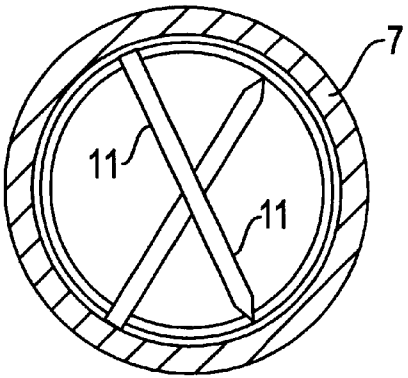
Figure 4:
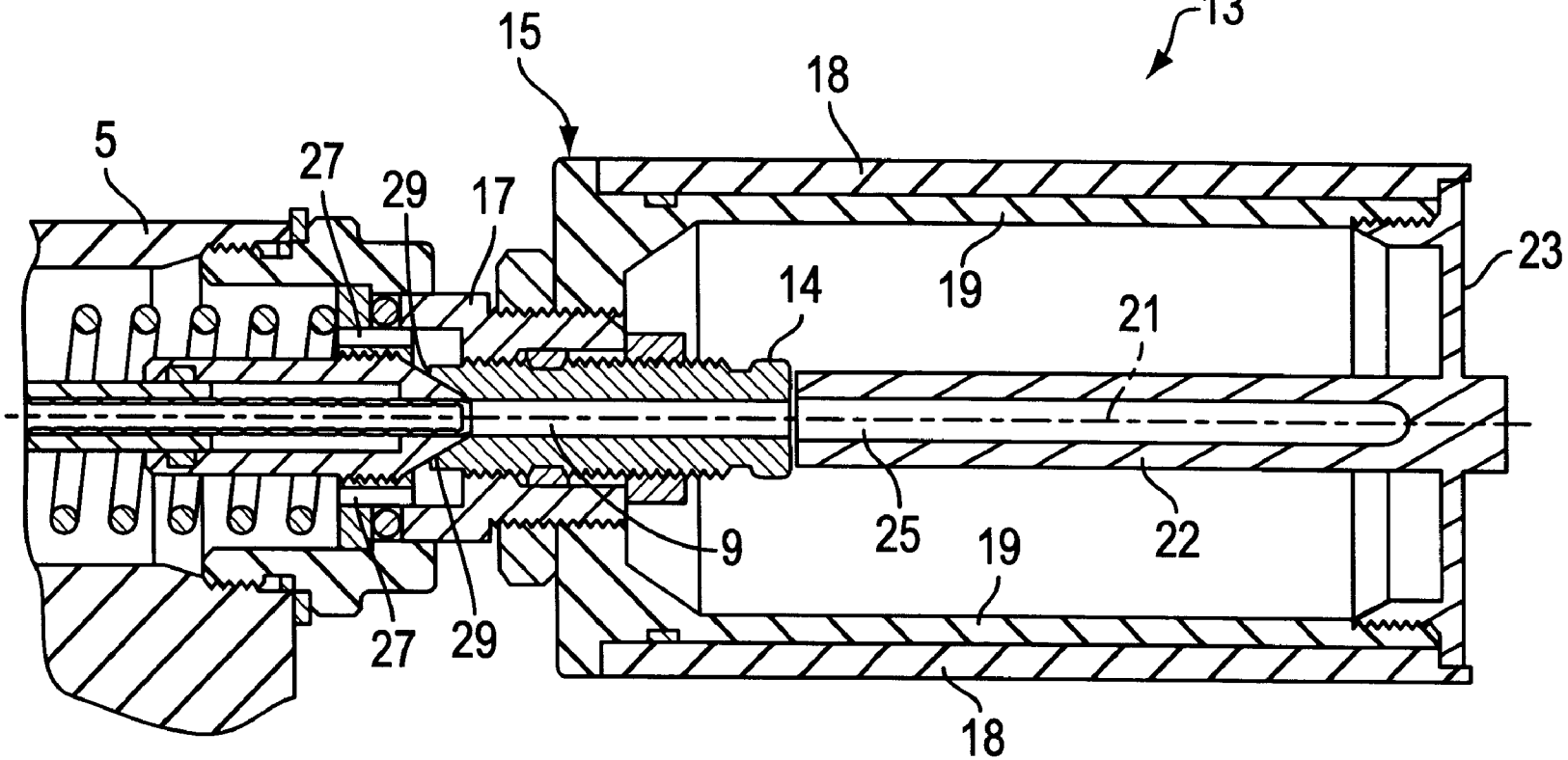
Figure 5B:
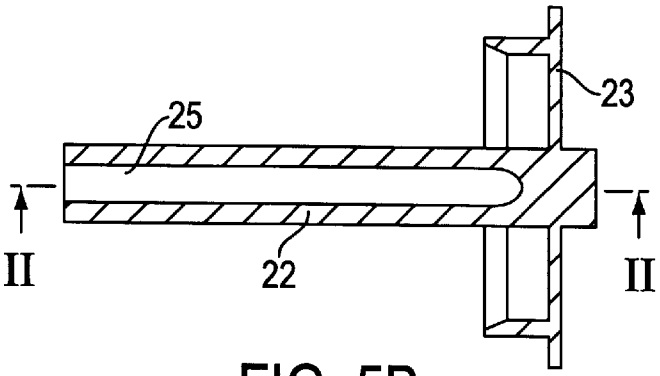
Figure 5C:
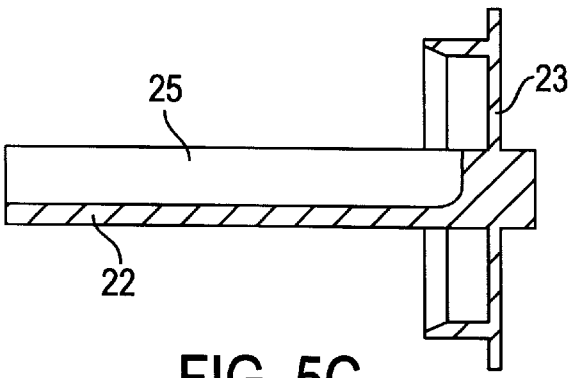
Figure 5A:
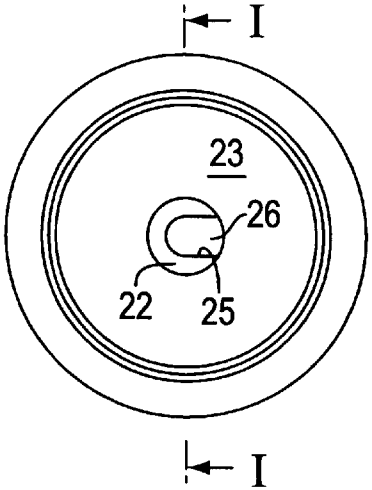
Figure 6:
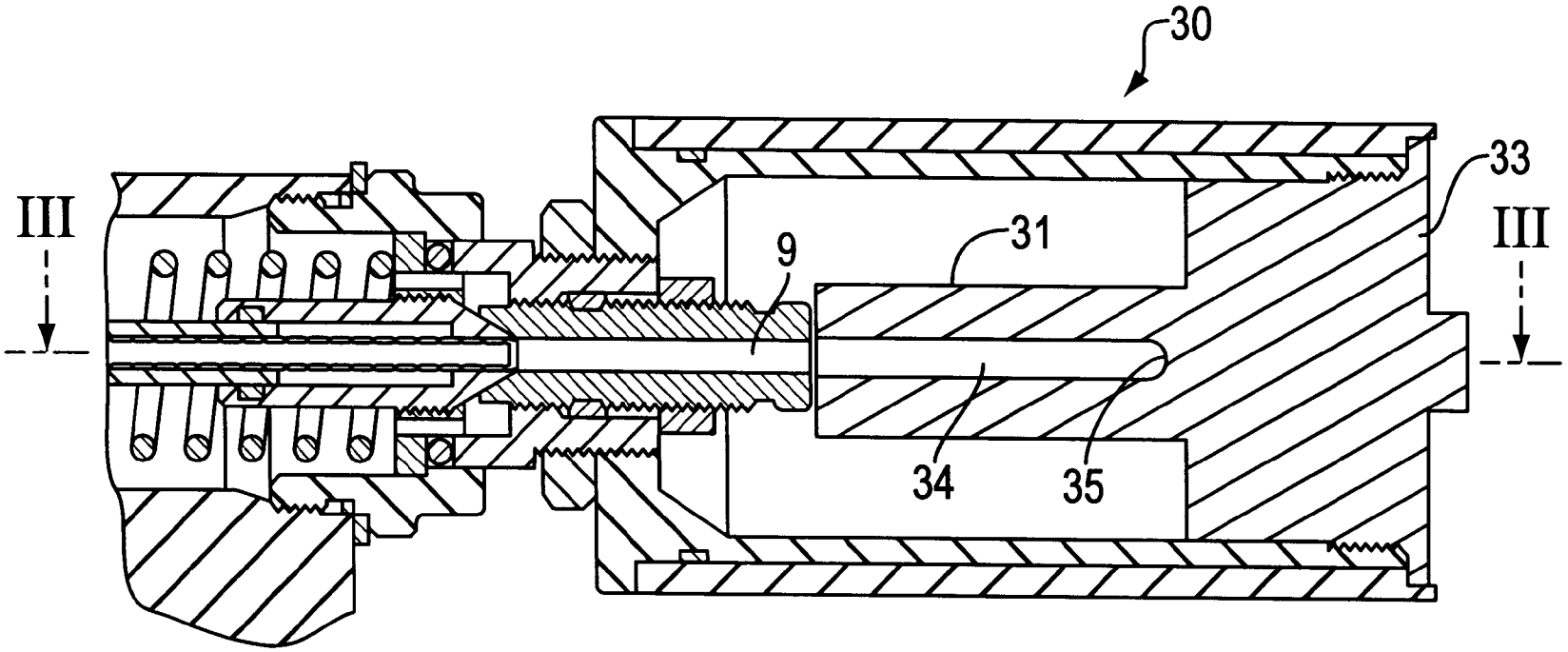
Figure 7:
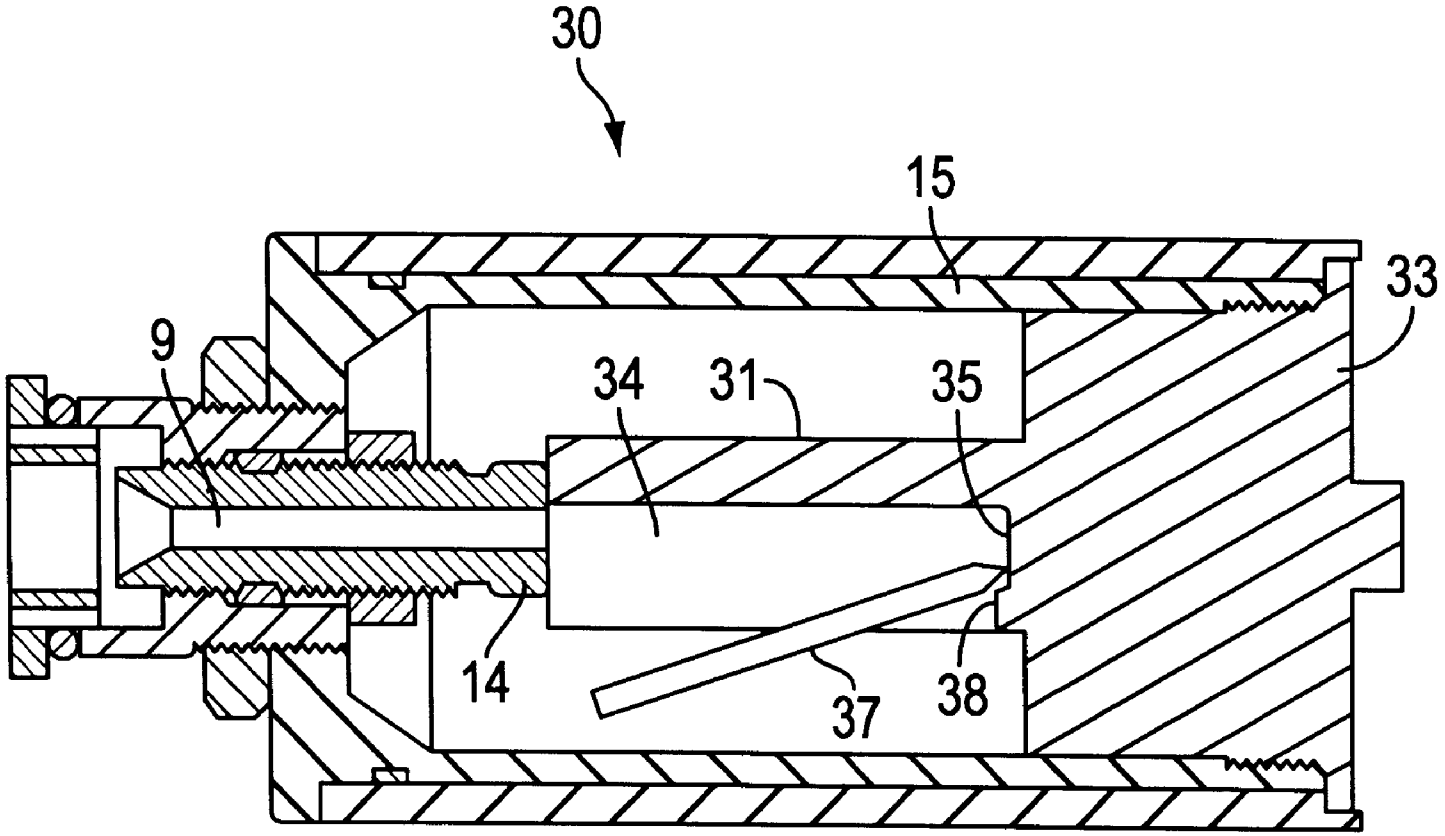
Figure 8:
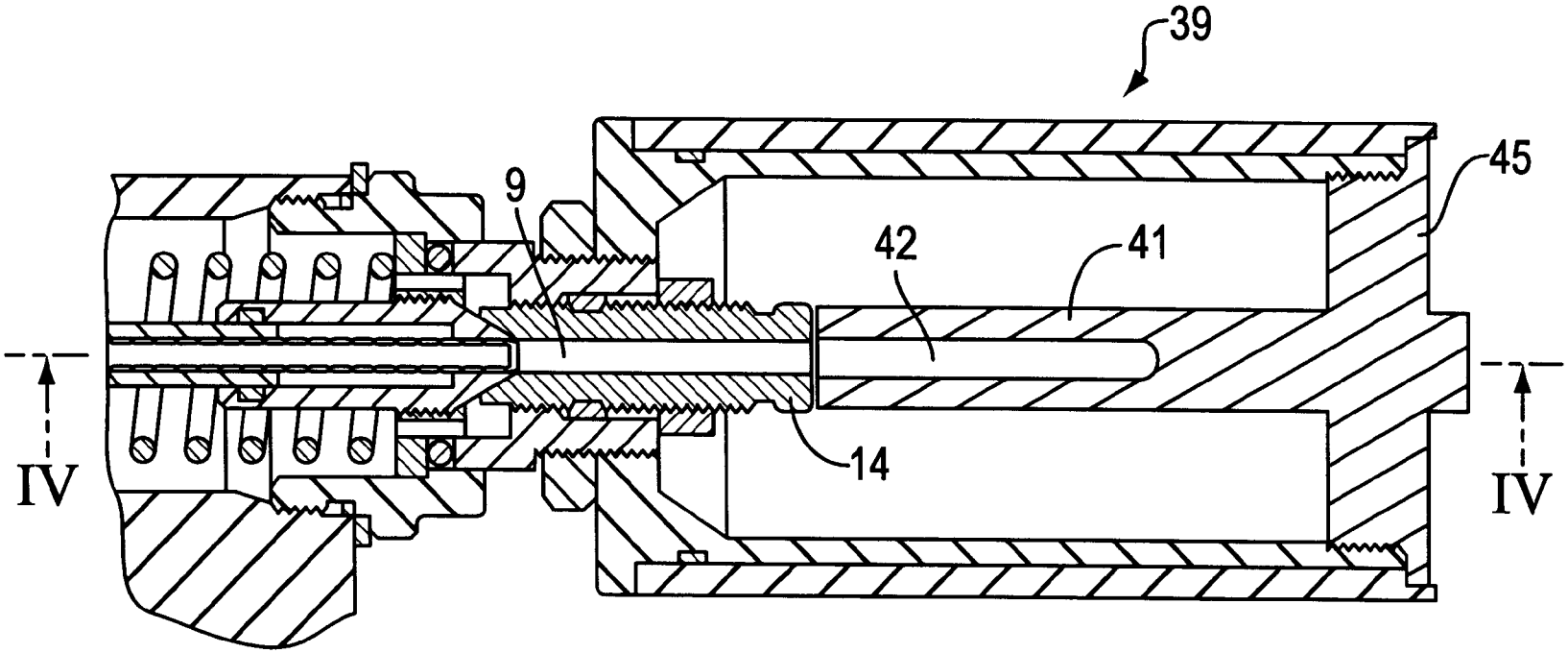
Figure 9:
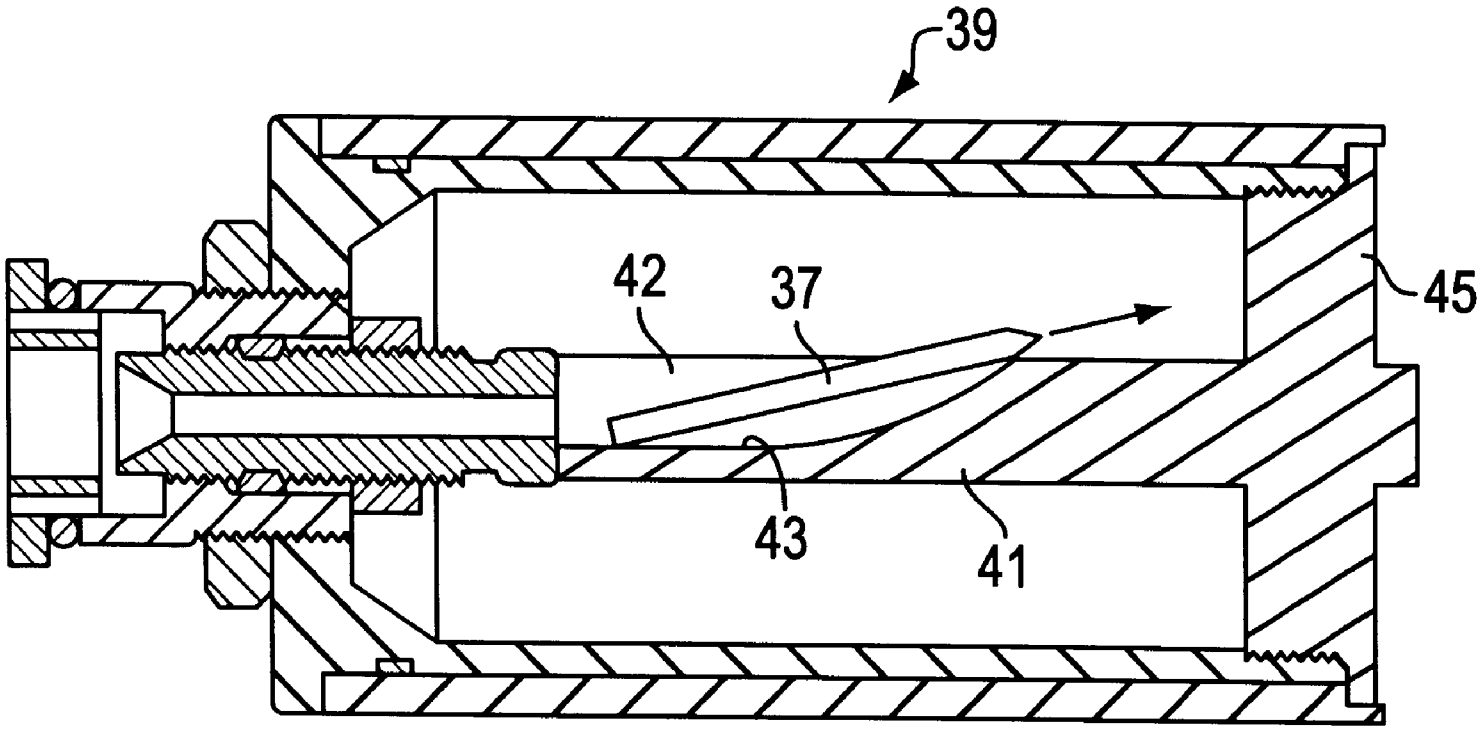
Figure 10:
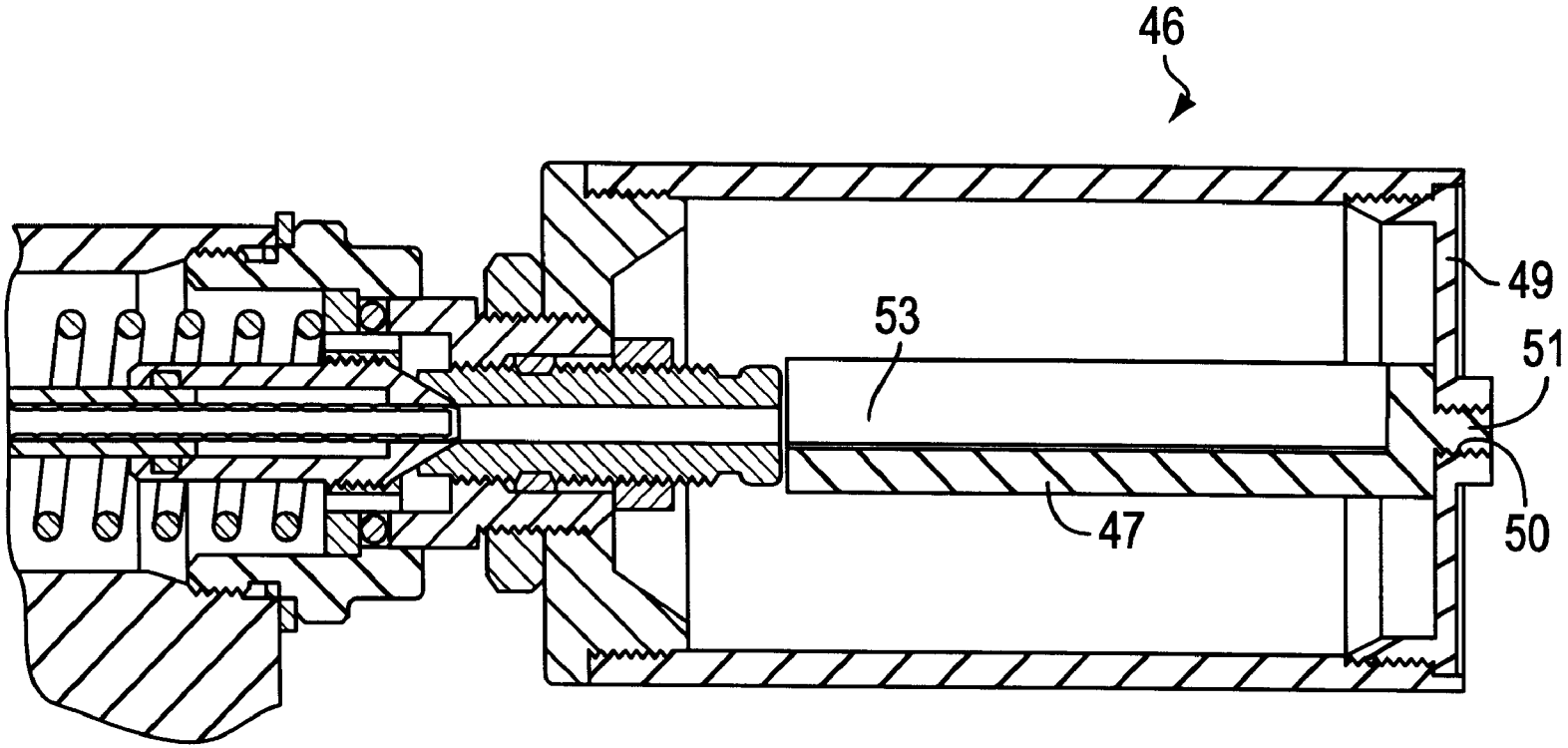
Figure 11B:
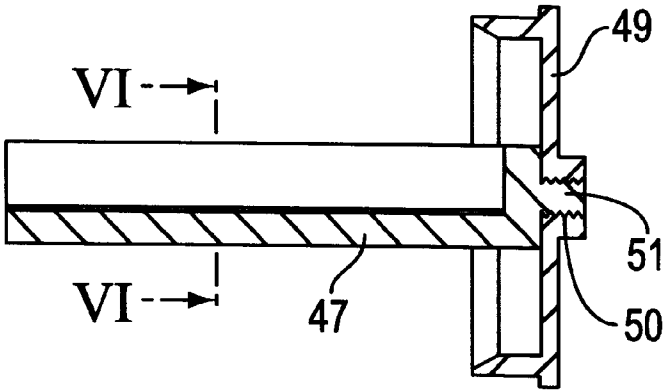
Figure 11C:
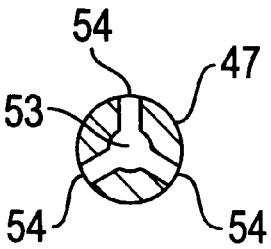
Figure 11A:
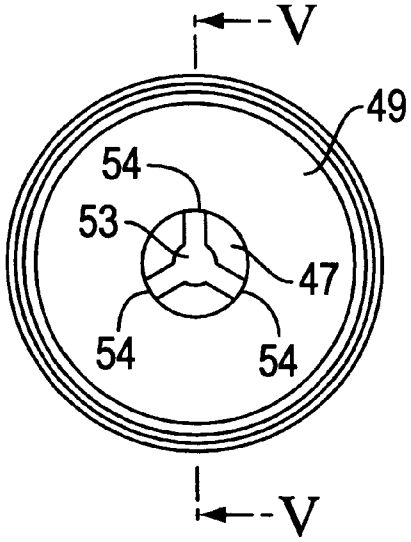
Figure 12:
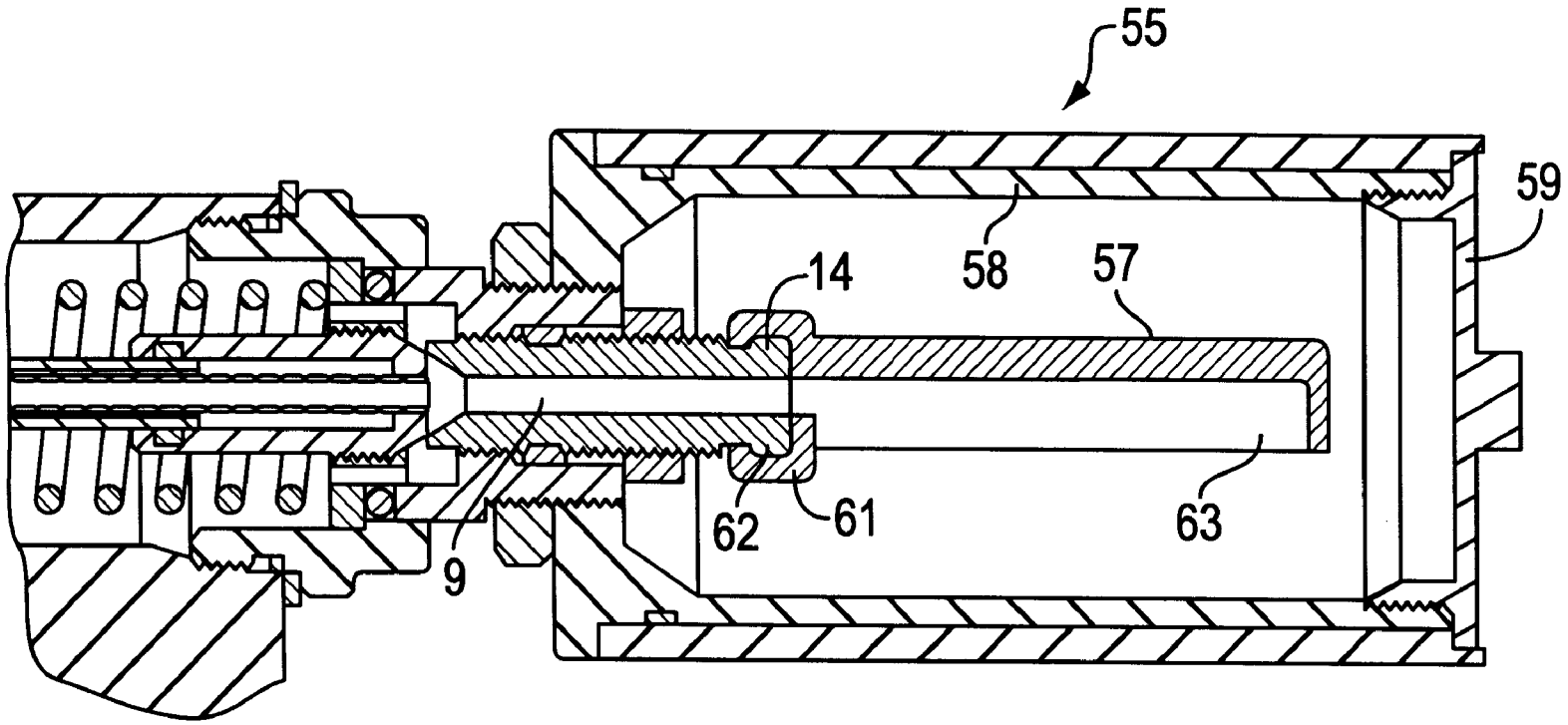

FIGS. 3 (*a*) and (*b*) show a deficiency of a conventional broken piece collecting assembly, in which FIG. 3(*a*) is a longitudinal sectional view and FIG. 3(*b*) is a view as seen from the side of the path 9 in FIG. 3(*a*);

FIG. 4 is a longitudinal sectional view of a broken piece collection assembly according to the first embodiment of the present invention;

FIGS. 5 (*a*)–(*c*) show the broken piece receiver member and a bottom cap of FIG. 4, in which FIG. 5(*a*) is a view as seen from the inlet side end of the broken piece receiver member, FIG. 5(*b*) is a sectional view taken along a line A—A in FIG. 5(*a*), and FIG. 5(*c*) is a sectional view taken along a line B—B in FIG. 5(*b*);

FIG. 6 is a longitudinal sectional view of a broken piece collecting assembly according to the second embodiment of the present invention;

FIG. 7 is a sectional view taken along a line C—C of the broken piece collecting assembly in FIG. 6;

FIG. 8 is a longitudinal sectional view of a broken piece collecting assembly according to the third embodiment of the present invention;

FIG. 9 is a sectional view taken along a line D—D of the broken piece collecting assembly in FIG. 8;

FIG. 10 is a longitudinal sectional view of a broken piece collecting assembly according to the fourth embodiment of the present invention;

FIGS. 11 (*a*)–(*c*) show the broken piece receiver member and a bottom cap in FIG. 10, in which FIG. 11(*a*) is a view seen from the inlet side end of the broken piece receiver member, FIG. 11(*b*) is a sectional view taken along a line E—E in FIG. 11(*a*), and FIG. 11(*c*) is a sectional view taken along a line F—F in FIG. 11(*b*);

FIG. 12 is a longitudinal sectional view of a broken piece collecting assembly according to the fifth embodiment of the present invention.

DETAILED DESCRIPTION OF THE INVENTION

In the embodiment of the present invention, the container is formed in a hollowed cylinder, the broken piece receiver member comprises a rod member extending to the outlet port of the path from a bottom of the container which locates on the opposite side of the outlet port of the path, and the groove is formed such that it extends in a longitudinal direction along the broken piece receiver member and opens at the side of the broken piece receiver member. The broken pieces of the mandrels discharged from the outlet port of the housing are temporarily received in the groove and then discharged into the container from the open portion of the groove.

In the embodiment of the present invention, the end face of the groove facing to the container bottom is formed parallel to the container bottom to provide a stop face for the tip of the received broken piece. In another embodiment, the groove bottom at the side of the container bottom is inclined to become gradually shallower as the groove approaches the container bottom, providing a guide surface so that the tip of the received broken piece go out of the groove as it is advancing.

In the embodiment of the present invention, the groove includes a cavity extending through a central portion of the broken piece receiver member, the cavity opens at least in two directions toward the side of the broken piece receiver member.

In the embodiment of the present invention, the container bottom is formed as a cap removable from the container body. Furthermore, the broken piece receiver member is preferably fixed to the cap. Also, the broken piece receiver member is preferably detachably fixed to the cap.

In the embodiment of the present invention, the broken piece receiver member is fixed to the outlet port of the path, and it extends from the outlet port of the path and stops short of the container bottom.

Figure 1:
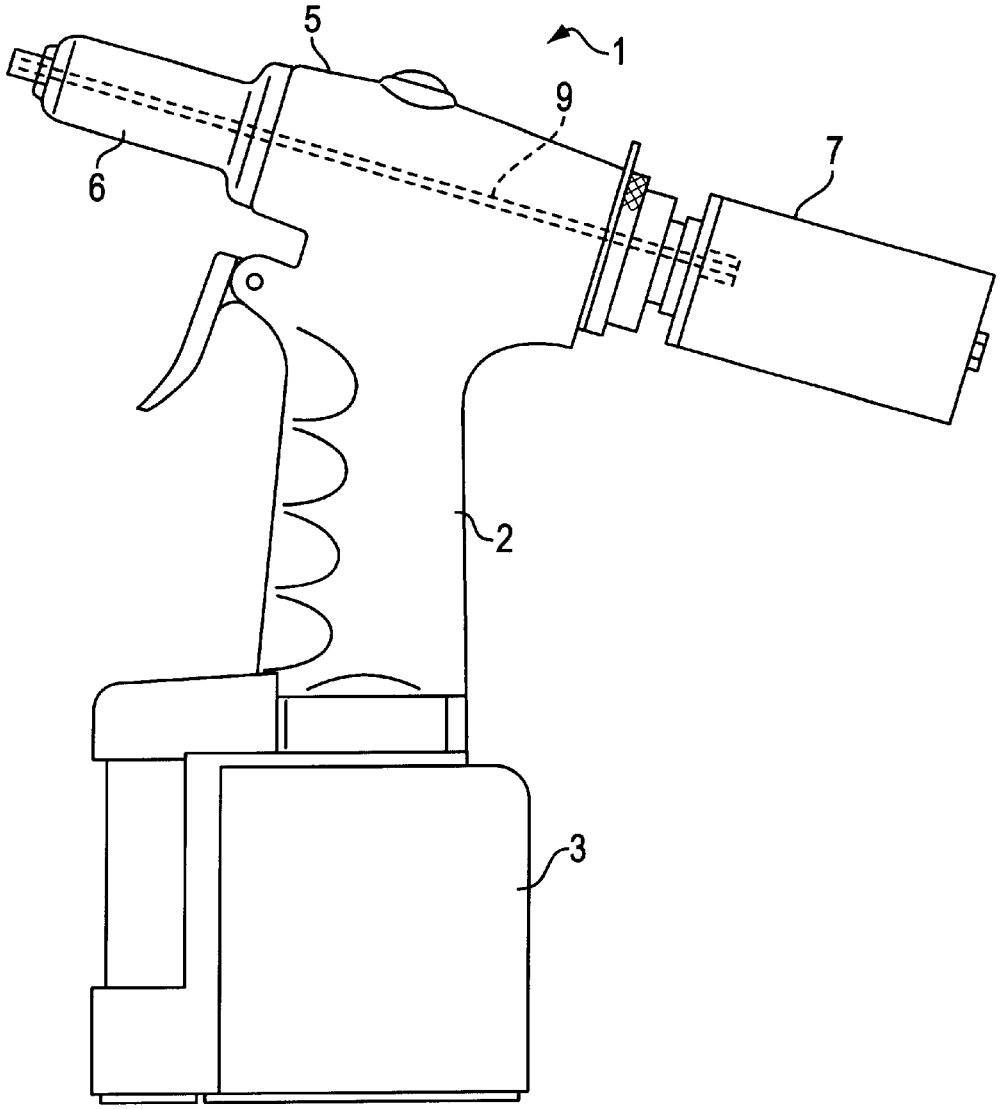
FIG. 1 is a side view showing an entire blind rivet setting tool.
Figure 2:
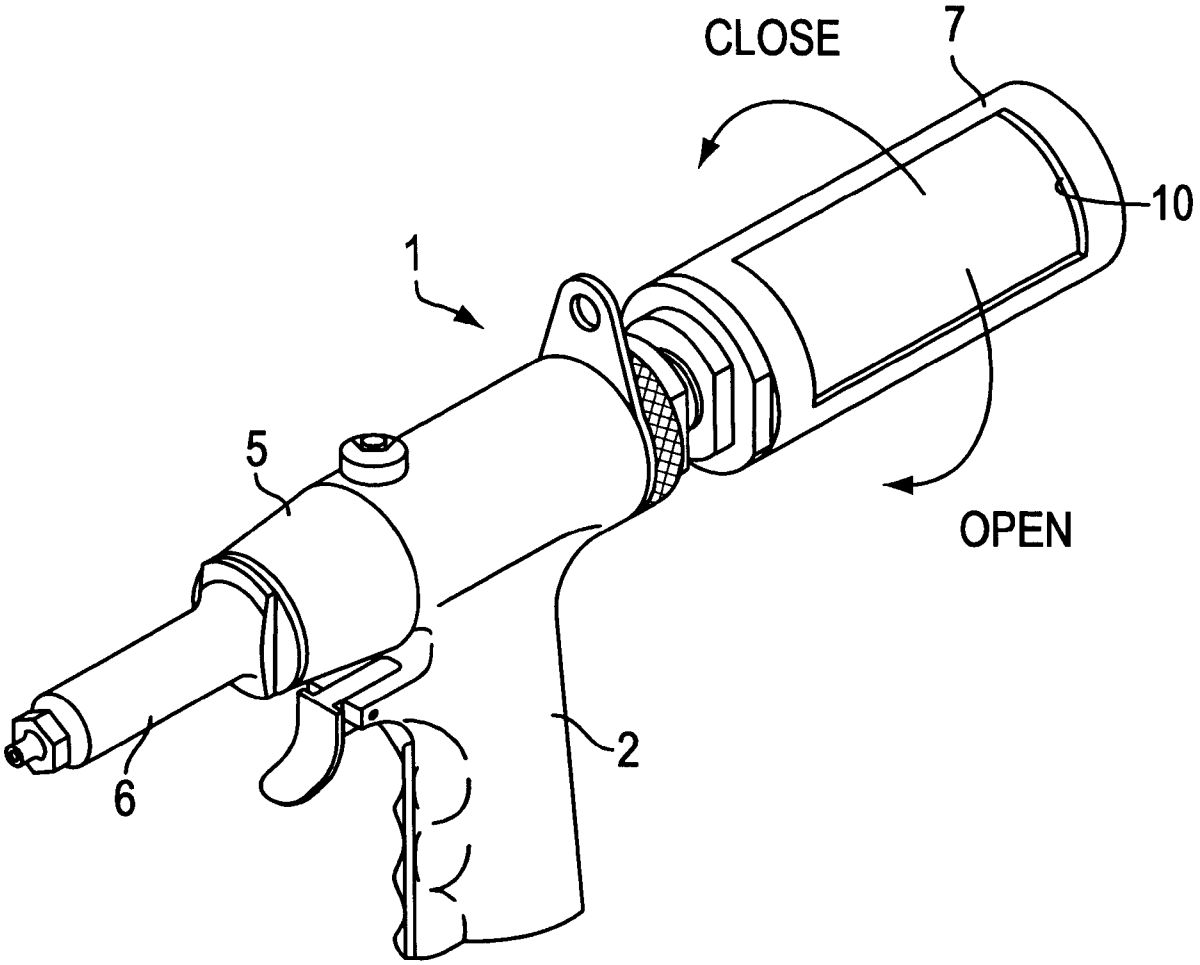
FIG. 2 is a perspective view of the blind rivet setting tool in FIG. 1 showing a structure of a broken piece collecting assembly of thereof.

The preferred embodiments of the present invention will now be described with reference to the drawings. FIGS. 4 and 5 show a broken piece collecting assembly 13 according to a first embodiment of the present invention. The broken piece collecting assembly 13 includes a container 15 enclosing the outlet port 14 of the path 9 and extending to elongate the path 9 for collecting the broken pieces as discharged from the path 9. The container 15 is formed in a hollowed cylinder. It is fixed, at the outlet port 14 of the path for example by means of screws, to a holding portion 17 extending from the housing 5. The container extends to the rear side of the housing 5 to be in alignment with the axis of the path 9. The outer circumferential surface of the container 15 is provided with a rotary cover 18 having an opening 10 as previously described in FIG. 2, which is capable to rotate to align with an opening (not shown) formed on an inner side wall 19. Through the alignment of both openings, the broken pieces contained within the container can be discharged outside.

The broken piece collecting assembly 13 is provided with a broken piece entangling prevention means. The broken piece entangling prevention means comprises an elongated rod-like broken piece receiver member 22 extending along the axis 21 of the path 9 in the container 15. In the first embodiment of FIG. 4, the broken piece receiver member 22 extends from a bottom cap 23 of the container located opposite side of the outlet port 14 toward the outlet port 14. In particular, as shown in FIGS. 5(*a*), (*b*) and (*c*), the broken piece receiver member 22 is integrally molded into a shape upstanding from the central portion of a bottom cap 23. This allows the broken piece receiver member 22 to be mounted on the container 15 in alignment with the outlet port 14 of the path 9 by assembling the bottom cap 23 into the container 15. The broken piece receiver member 22 is provided with an elongated groove 25 for receiving the broken piece of the mandrel of the fastener such as blind rivet in a posture that it is discharged from the outlet port 14 of the path 9. This groove 25 extends in a longitudinal direction at the center of the broken piece receiver member 22, and is formed to open at the side of the broken piece receiver member 22. This allows the broken piece discharged from the outlet port 14 of the path 9 to be temporarily received in the groove 25, and then to be discharged from the open portion 26 of the groove 25 into the container.

In FIG. 4, the broken piece of the mandrel is transferred from the outlet port 14 to the groove 25 of the broken piece receiver member 22 by broken-piece-suction air pressure supplied to the path 9 through a pressurized air port 27 and an orifice 29. As for the details of this suction air pressure, refer to Japanese Patent Laid Open No. 07-299539, in particular, FIG. 4 and its relating description. In the meantime, a case of no suction air pressure applied is explained a bit. When the mandrel of the fastener is inserted into the nose under the condition that the broken pieces were accumulated within the path 9, the broken pieces are mechanically pushed out and discharged from the outlet port 14. When the broken pieces is discharged from the outlet port 14, the broken piece is received into the groove 25 in its posture along the axis 21 of the path 9 and advances in its posture as it is. The broken piece advancing within the groove 25 stops when its tip strikes against the stop face formed parallel to the container bottom of the groove 25. After stopped, the broken piece is discharged into the container from the open portion 26 of the groove 25 in its posture along the axis 21 by its own weight or the fastening operation. In this way, each of the broken pieces of the mandrels discharged from the path 9 is temporarily received by the broken piece receiver member 22 which keeps its posture in the axial direction, then it drops into the container, so that the broken piece would not upset within the container. Accordingly, even if many broken pieces are contained within the container, the broken pieces are prevented from entangling each other. Furthermore, due to the broken piece receiver member 22, there is no enough space to upset the mandrel within the container. Thus, the broken pieces dropped into the container are also prevented from entangling each other. Therefore, the broken pieces within the container can smoothly be disposed, because of no obstacle to the fastening operation due to the entangling of the broken pieces. The material of the broken piece collecting assembly 13 may be either metal or plastic.

FIGS. 6 and 7 show a broken piece collecting assembly 30 according to a second embodiment of the present invention. Such a broken piece collecting assembly 30 deals with a case that the broken piece of the mandrel is short in length. As shown in Figures, the broken piece receiver member 31 is formed to be larger in diameter and shorter in length than these of the broken piece receiver member 22 of the first embodiment. Furthermore, the bottom cap 33 is formed to be thicker so as to match the length of the broken piece receiver member 31. Because the broken piece receiver member 31 has a large diameter, the groove 34 is formed to be deeper. The end face 35 of the groove 34 facing with the container bottom is formed parallel to the container bottom and provide a stop face for the tip of the received broken piece. Such a situation is shown in FIG. 7. A broken piece 37 discharged from the outlet port 14 of the path 9 advances in the groove 37, then stops when its tip strikes against the stop face 35 of the groove 34, and drops on the side of the container 15 by it own weight. It is preferable to provide a projection on the stop face 35, which causes the broken piece to drop gently by engaging with the tip of the broken piece 37. Since other portions are same as those of the first embodiment, explanation therefor is omitted.

FIGS. 8 and 9 show a broken piece collecting assembly 39 according to a third embodiment of the present invention. In such broken piece collecting assembly 39, the shape of the groove of the broken piece receiver member of the first embodiment is modified. In FIGS. 8 and 9, the groove 42 of the broken piece receiver member 41 is formed as a guide surface which is inclined so that the groove 42 becomes shallower as its bottom surface 43 approaches the bottom cap 45. The broken piece 37 transferred from the outlet port 14 of the path 9 is discharged from the groove 42 as its tip advances along the inclined guide surface of the groove bottom. Therefore, the broken piece is discharged from the groove while it is advancing in the groove. Since other portions are same as those of the first embodiment, explanation therefor is also omitted.

FIGS. 10 and 11 show a broken piece collecting assembly 46 according to a fourth embodiment of the present invention. In the broken piece collecting assembly 46, the shape of the groove of the broken piece receiver member of the first embodiment is modified, and also, the broken piece receiver member 47 and the bottom cap 49 are formed as discrete parts, and connected together by driving a outer threaded end portion 51 of the broken piece receiver member 47 into a inner threaded portion 50 formed at the center portion of the bottom cap 49. This structure enables the broken piece collecting assembly 46 to deal with the broken pieces having various lengths by exchanging the broken piece receiver member only. In this embodiment, the groove of the broken piece receiver member 47 includes a cavity 53 which extends through the center portion of the broken piece receiver member. The cavity 53 further extends toward the side of the broken piece receiver member 47 and opens at three equidistantly (120°) spaced open portions 54. The number and spacing of the open portions 54 may be arbitrarily selected, for example, the number of the open portions 54 may be two, in addition to three as shown in FIG. 11. In that case of two open portions, any spacing that the open portions are not diametrically aligned with each other may be selected. This is because if the two open portions are diametrically aligned, there is a fear that the broken pieces may be entangled each other across the broken piece receiver member. In this way, by forming the cavity 53, the broken piece can be received along the axis of the broken piece receiver member to keep the posture of the broken piece, thereby ensuring that broken piece is prevented from upsetting. Since other portions are same as those of the first embodiment, explanation therefor is also omitted.

FIG. 12 shows a broken piece collecting assembly 55 according to a fifth embodiment of the present invention. The broken piece receiver member 57 of this broken piece collecting assembly 55 is not connected with the bottom cap 59 of the container 58, different from the broken piece receiver members of the first to fourth embodiments. The broken piece receiver member 57 is fixed to the outlet 14 of the path 9, the member 57 extends from the outlet port 14 and stops short of the bottom cap 59. The broken piece receiver member 57 is made of elastic materials so that it can be fitted in the outlet 14 of the path 9. The fitting portion 61 to the outlet 14 is snap fitted to the corresponding portion 62 of the outlet 14. The broken piece receiver member 57 is provided with a groove 63 for receiving the broken piece. With such a construction, this broken piece collecting assembly 55 can deal with the broken pieces having various lengths by only exchanging the broken piece receiver member 57. Since other portions are same as these of the first embodiment, explanation therefor is also omitted.

As described above, the broken piece collection assembly of the present invention includes an elongated broken piece receiver member extending along the axis of the path in the container. The broken piece receiver member is provided with an elongated groove for receiving the broken piece discharged from the path in a posture as it is discharged. Each of the broken pieces of the mandrels is temporarily received by the broken piece receiver member which keeps its posture in the axial direction, and then drops it into the container, so that the broken piece would not upset in a diameter direction into engagement with the inner wall of the container. Consequently, entangling of the broken piece, resulting in blocking the outlet port of the path, can be effectively prevented even if many broken piece are contained within the container. Furthermore, the broken pieces within the container can smoothly be disposed because of no fastening obstacle due to the entangling of the broken pieces. Furthermore, the fasteners which can be used in the present invention may be of any type, such as blind rivets and lock-bolts so long as the mandrel of the fastener is broken during fastening operation. Furthermore, the broken piece collecting assembly can deal with the broken pieces having various lengths by only exchanging the broken piece receiver member.

What is claimed is:

1. A fastener setting tool constructed so that the mandrel of a fastener is inserted into a nose at the front end of the tool; the body of the fastener projected from the nose is inserted into the mounting hole of a workpiece such as panel; under that condition, the mandrel is pulled enough to break it to enlarge the shank of the fastener body to fix the fastener to a workpiece by the enlarged shank portion and a flange of the fastener body; and the tool comprising a broken piece collection assembly for collecting, from the nose through a path within the tool, the broken pieces of the mandrels which are broken by the above pulling operation, characterized in that: the broken piece collection assembly comprises a container enclosing the outlet port of the path and extending to elongate the path to collect the broken pieces discharged from the path, and a broken piece entangling prevention means disposed in the container, the broken piece entangling prevention means comprising an elongated broken piece receiver member extending in the container along the axis of the path, the broken piece receiver member being provided with an elongated groove to receive the broken piece discharged from the path in the posture as it is discharged.

2. A fastener setting tool according to claim 1, wherein the container is formed in a hollowed cylinder, the broken piece receiver member comprises a rod member extending, to the outlet port of the path, from the container bottom located on the side opposite to the outlet port, the groove extends longitudinally along the broken piece receiver member and is formed to open on the side of the broken piece receiver member, so that the broken piece of the mandrel discharged from the outlet port of the path is temporarily received in the groove and then discharged into the container.

3. A fastener setting tool according to claim 2, wherein the end face of the groove facing with the container bottom is formed parallel to the container bottom to provide a stop face for the tip of the received broken piece.

4. A fastener setting tool according to claim 2, wherein the groove bottom at the side of the container bottom is inclined to become shallower as the groove approaches the container bottom to provide a guide surface so that the tip of the received broken piece goes out of the groove with its advance.

5. A fastener setting tool according to claim 1, wherein the groove includes a cavity extending through a central portion of the broken piece receiver member, and the cavity opens at least in two directions toward the side of the broken piece receiver member.

6. A fastener setting tool according to any one of claims 2–5, wherein the container bottom is formed as a cap which is removable from the body of the container.

7. A fastener setting tool according to claim 6, wherein the broken receiver member is fixed to the cap.

8. A fastener setting tool according to claim 7, wherein the broken piece receiver member is detachably fixed to the cap.

9. A fastener setting tool according to any one of claims 2–5, wherein the broken piece receiver member is fixed to the outlet port of the path, and the receiver member extends from the outlet port of the path and stops short of the container bottom.

10. A fastener setting tool according to claim 9 wherein the container bottom is formed as a cap which is removable from the body of the container.

11. A blind rivet setting tool comprising a nose for receiving the mandrel of a blind rivet and for contacting the head of the rivet, a set of jaws for gripping the mandrel, a power source operable through said jaws to pull the mandrel into the rivet body to set the rivet and thereupon to break off a portion of the mandrel, a passage extending into the tool to facilitate removal of the broken mandrel portion, and a collection container for receiving the mandrel portions, said container including a receiver having an elongated groove aligned with said passage so that mandrel portions aligned with said passage become aligned with said groove.

12. A tool as claimed in claim 11 wherein said groove includes an elongated opening to facilitate transfer of the portions from said groove into said container.

* * * * *